US010883269B2

(12) United States Patent
Nousiainen

(10) Patent No.: US 10,883,269 B2
(45) Date of Patent: Jan. 5, 2021

(54) FRAMED ELEMENT AND ITS USE

(71) Applicant: Oy FCR Finland Ltd, Nousiainen (FI)

(72) Inventor: Ari Nousiainen, Paimio (FI)

(73) Assignee: Oy FCR Finland Ltd, Nousiainen (FI)

( * ) Notice: Subject to any disclaimer, the term of this patent is extended or adjusted under 35 U.S.C. 154(b) by 0 days.

(21) Appl. No.: 16/485,186

(22) PCT Filed: Feb. 27, 2018

(86) PCT No.: PCT/EP2018/054771
§ 371 (c)(1),
(2) Date: Aug. 12, 2019

(87) PCT Pub. No.: WO2018/158231
PCT Pub. Date: Sep. 7, 2018

(65) Prior Publication Data

US 2020/0002946 A1 Jan. 2, 2020

(30) Foreign Application Priority Data

Feb. 28, 2017 (EP) ..... 17158279

(51) Int. Cl.
*E04C 2/38* (2006.01)
*B63B 3/48* (2006.01)
(Continued)

(52) U.S. Cl.
CPC ..... *E04C 2/384* (2013.01); *B63B 3/48* (2013.01); *E04B 1/942* (2013.01); *E04C 2/02* (2013.01);
(Continued)

(58) Field of Classification Search
CPC . E04C 2/384; E04C 2/02; E04C 2/525; E04C 2002/002; B63B 3/48; E04B 1/942;
(Continued)

(56) References Cited

U.S. PATENT DOCUMENTS 4,207,366 A * 6/1980 Tyler ..... B29D 24/005 428/73
5,424,497 A * 6/1995 Dias ..... E04B 1/86 181/286
(Continued)

FOREIGN PATENT DOCUMENTS

CA 2131022 A1 7/1994
EP 1637666 A2 3/2006
(Continued)

OTHER PUBLICATIONS

European Patent Office, search report of European patent application No. EP17158279, dated May 23, 2017, 3 pages.

*Primary Examiner* — Joshua K Ihezie
(74) *Attorney, Agent, or Firm* — Berggren LLP

(57) ABSTRACT

A framed element includes an insulating core layer, an upper surface layer arranged on the insulating core layer, a frame structure including frame profiles which have been arranged to form at least part of the outer edges of the element and elongated support profiles in the length and/or width direction of the element. The insulating core layer is made of foamed glass or a combination of lightweight aggregates and a fire-retardant resin. The element further includes an elastic sealing compound arranged at least partly between the core layer and the upper surface layer of the element.

10 Claims, 1 Drawing Sheet

(51) Int. Cl.

| | |
|---|---|
| ***E04B 1/94*** | (2006.01) |
| ***E04C 2/02*** | (2006.01) |
| ***E04C 2/52*** | (2006.01) |
| ***E04F 15/02*** | (2006.01) |
| *E04C 2/00* | (2006.01) |

(52) U.S. Cl.
CPC ..... *E04C 2/525* (2013.01); *E04F 15/02188* (2013.01); *E04F 15/02194* (2013.01); *E04C 2002/002* (2013.01); *E04F 2290/023* (2013.01); *E04F 2290/047* (2013.01)

(58) Field of Classification Search
CPC ..... E04F 15/02188; E04F 15/02194; E04F 2290/023; E04F 2290/047; E04F 2290/02; E04F 15/022; E04F 15/02464; E04F 15/181
See application file for complete search history.

(56) References Cited

U.S. PATENT DOCUMENTS 7,897,235 B1* 3/2011 Locher ..... B60R 13/08 428/71
9,151,046 B1* 10/2015 Francavilla ..... E04B 2/84
2004/0067373 A1* 4/2004 Kennedy ..... E04C 2/384 428/457
2004/0261356 A1* 12/2004 Wrass ..... E04C 2/388 52/782.1
2005/0188649 A1* 9/2005 Hagen, Jr. ..... E04B 1/7604 52/782.1
2005/0235588 A1* 10/2005 Knight ..... E04F 15/105 52/263
2006/0265985 A1* 11/2006 Nichols ..... E04C 2/384 52/309.8
2007/0051060 A1 3/2007 Moore
2009/0217612 A1* 9/2009 Window ..... E04B 5/04 52/414
2010/0031587 A1* 2/2010 Weeks ..... E04F 15/02183 52/126.6
2010/0307089 A1* 12/2010 Cox ..... E04B 1/14 52/309.4
2011/0197532 A1* 8/2011 Teng ..... E04D 13/1668 52/407.2
2011/0282633 A1* 11/2011 Bui ..... E04B 1/165 703/1
2016/0159028 A1* 6/2016 Oleske ..... B32B 13/08 428/116
2016/0237683 A1* 8/2016 Husin-Ali ..... E04B 1/14
2018/0208388 A1* 7/2018 Austerberry ..... E04C 2/284
2018/0235383 A1* 8/2018 Josey ..... A47F 5/0043
2019/0078326 A1* 3/2019 Glen ..... B32B 3/08

FOREIGN PATENT DOCUMENTS

WO 2008055292 A1 5/2008
WO 2014017939 A1 1/2014

* cited by examiner

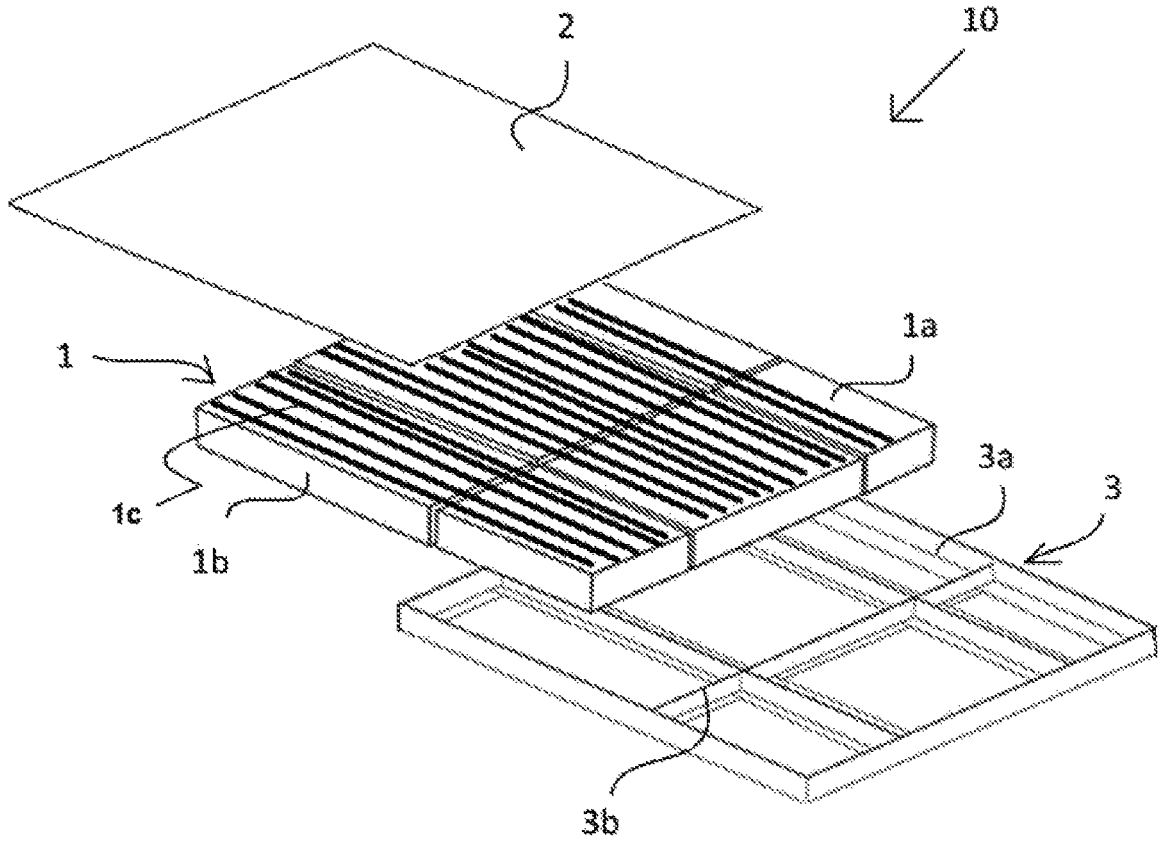
2
10
1
1a
1c
1b
3a
3
3b

FRAMED ELEMENT AND ITS USE

PRIORITY

This application is a U.S. national application of the international application number PCT/EP2018/054771 filed on Feb. 27, 2018 and claiming priority of European application EP17158279.4 filed on Feb. 28, 2017 the contents of all of which are incorporated herein by reference.

FIELD OF THE INVENTION

The present invention relates to a framed element and its use according to the preambles of the independent claims presented below.

BACKGROUND OF THE INVENTION

Different kind of construction layers are used in the floor constructions of the wet unit modules or other constructions in order that the required water resistance and/or fire safety and rigid insulated structure have been achieved. Current wet unit floor modules, especially used in marine applications, comprise typically glass fibre floors with different kinds of surface patterns integrated or fixed on top of that. The floor surface is typically constructed over a supporting framework. Typically, the framework of the wet unit floor modules is manufactured from galvanised steel. Piping, such as water pipes and drainage pipes, are assembled under the floor structure and in some cases ventilation air duct is also assembled under the floor structure. Typically piping and air ducts are supported by brackets to the floor surface or the supporting framework. The construction and the piping may be insulated with the separate insulation layer under the floor surface. Mineral wool is typically used as an insulation material. The construction may also comprise separate back-up leakage tray assembled to the framework.

These kinds of module constructions are quite heavy and also risky for water leakages and moisture damages after damaging of one or more layers or parts of the construction. The size of the modules is limited due to the required rigidity of the module. Most of the materials used in the construction are not recyclable after renovation. Especially, the water resistance of the module construction is not good after breakage of the surface layer or in the case of water leakage, e.g. if the insulation material is wetted and so the construction may be become mouldy, or the safe load of the construction may become weaker due to corrosion of the construction.

SUMMARY OF THE INVENTION

It is an object of the present invention to reduce or even eliminate the above-mentioned problems appearing in prior art.

The object of the invention is to provide a lightweight, durable, fire safety and corrosion resistant element.

Further, it is an object of the present invention to provide a water resistant element construction, which eliminates the wetting of the element's structures in the case of water leakage or moisture damage.

Especially, an object of the present invention is to provide an element for use as a floor element in wet unit modules or as a floor for wet areas or the like.

In order to achieve among others the objects presented above, the invention is characterized by what is presented in the characterizing parts of the enclosed independent claims.

Some preferred embodiments of the invention will be described in the other claims.

The embodiments and advantages mentioned in this text relate, where applicable, both to the element and the uses according to the invention, even though it is not always specifically mentioned.

A typical framed element according to the invention comprises

- an insulating core layer made of foamed glass or a combination of lightweight aggregates and fire retardant resin,
- an upper surface layer arranged on the insulating core layer, and
- a frame structure comprising frame profiles which have been arranged to form at least part of the outer edges of the element and elongated support profiles in the length and/or width direction of the element and which support profiles have been arranged at least partly inside the insulating core layer, and
- an elastic sealing compound or a combination of the support mesh and the inorganic or mainly inorganic coating compound, which is arranged at least partly between the insulating core layer and the upper surface layer of the element.

The framed element according to the invention is a construction element which is suitable for use in lightly constructed floor, wall or roof constructions. Especially, it is useful as a construction element in wet unit modules or other constructions where water resistance, fire safety and rigid insulated structure is needed. Preferably, the framed element according to the invention is used as a floor element in wet unit modules or the like. A wet unit refers in the present description to any sanitary cabin, such as toilet, bathroom, washroom or the like. The element according to the invention provides e.g. a ready-made floor construction for use in the wet unit modules. Especially, a framed element according to the invention may be used as a floor element in the sanitary units of the ship cabins, since the properties of element fulfil required regulations for marine constructions, such as IMO Solas. A framed element according to the invention may also be used as a floor, a wall and/or a roof element, especially for wet areas or the like, such as kitchens, cold rooms or spa areas.

The present invention is based on a ready-made element construction, which comprises an insulating water-resistant core layer and a frame structure arranged at least partly inside the insulating core layer. The frame structure forms the frame structure of the element and it also provides the constructional strength for the element. The insulating core layer is made of foamed glass or a combination of lightweight aggregates and fire retardant resin. This combination of the insulating core layer and the frame structure provides a durable element construction, which is corrosion and moisture resistant and lightweight. In addition, the element construction of the invention has good fire safety and insulation properties. The fire safety properties of the element according to the present invention can be easily modified to satisfy different requirements by selecting suitable surface materials and/or changing a thickness of the insulating core layer. It is also possible to provide integrated channels for piping and air channels in the element construction. A lightweight prefabricated element construction according to the invention is also easy to handle.

The framed element according to the invention further comprises an elastic sealing compound or a combination of the support mesh and the inorganic or mainly inorganic coating compound, which is arranged at least partly between the insulating core layer and the upper surface layer of the element. In some embodiments, an elastic sealing compound is also arranged between the insulating core material and the frame structure. By using an elastic sealing compound for attaching insulating core layer to the frame structure and/or an upper surface layer to the insulating core layer, the durability of the element is further improved. The improved durability of the element may also be achieved by arranging only the combination of the support mesh and the inorganic or mainly inorganic coating compound between the insulating core layer and the upper surface layer of the element. The support mesh may also be called as reinforcing mesh and it may be any suitable mesh arranged between the insulating core layer and the upper surface layer of the element. According to an embodiment of the invention, the support mesh may be metal mesh, fibre glass-based mesh or other inorganic fibre-based mesh. The frame structure improves the durability of the element since the insulating core layer materials used in the element are fragile materials and when the insulating core layer is supported with the frame construction and attached to it by using an elastic sealing compound, the durable element construction with good insulation properties is achieved.

A non-combustible insulating core layer of the element is made of foamed glass or a combination of lightweight aggregates and fire retardant resin.

Foamed glass is a porous glass foam material. The foamed glass or foam glass may also be called as cellular glass. Its advantages as a building material include its lightweight with high compression stress strength and its good thermal and acoustic insulating properties. In addition, it is moisture-resistant material and so the element comprising foamed glass may also improve lifetime of the elements since it does not spoil in the case of water leakage. Foamed glass is also non-combustible material and so also the fire resistance properties of the element are improved when foamed glass is used as a material of the insulating core layer.

According to another embodiment of the invention, the insulating core layer is formed of a combination of lightweight aggregates and a fire retardant resin.

This kind of combination provides a lightweight, moisture resistant and inexpensive material for use in the element construction. Lightweight aggregates are mixed with fire retardant resin for forming a flame retarding insulating core layer. Lightweight aggregates refer in the present application to the aggregates or particles that weighs less than the usual stones as the same size. According to an embodiment of the invention lightweight aggregates are selected from the group comprising expanded clay aggregates, aggregates made of concrete, mortar, plaster, vermiculite or perlite, and any combination of them. Expanded clay aggregates are known, for example, as the product name of Leca. The particle size and shape of the lightweight aggregates may vary. Typically, the particle size may be varied between 4-20 mm or 4-10 mm. The fire retardant resin may be any fire resistant resin or glue by which lightweight aggregates may be attached to each other for forming uniform insulating core layer. In marine applications, the fire retardant resin to be used is selected so that it complies with the required European and/or International regulations for marine constructions and standards for fire protection. The combination of lightweight aggregates and fire retardant resin may be poured directly into the frame structure of the element, wherein an upper surface layer of the element may be attached also directly onto the insulating core layer. The elastic sealing compound or a combination of the support mesh and the inorganic or mainly inorganic coating compound may be arranged on the surface of insulating core layer made of a combination of lightweight aggregates and a fire retardant resin, i.e. between the insulating core layer and the upper surface layer, in order for improving durability of the element. Alternatively, a combination of lightweight aggregates and fire retardant resin may be poured firstly in pre-fabricated elements or boards, which may be arranged into the frame structure of the element for forming an integrated insulation layer. The elastic sealing compound or a combination of the support mesh and the inorganic or mainly inorganic coating compound may be arranged on the surface of the pre-fabricated elements in order that the upper surface layer can be attached to the element structure.

According to an embodiment of the invention, the insulating core layer is formed of board or boards made of foamed glass or a combination of lightweight aggregates and fire retardant resin. The insulating core layer may comprise one or more boards, which are arranged into the frame structure of the element for forming an integrated insulation layer. Typically, the insulating core layer comprises a plurality of the boards. The boards are dimensioned so that they fit between the elongated support profiles and frame profiles of the element. The elongated support profiles of the frame structure are in the joints between the boards. The insulating core layer is formed by arranging boards tightly against each other so that the whole area of the element comprises a substantially uniform layer of the insulating core layer material. Typically, the boards are attached to the frame structure by an elastic sealing compound by arranging the elastic sealing compound between them. Further, an upper surface layer of the element is attached on the insulating core layer by an elastic sealing compound or a combination of the support mesh and the inorganic or mainly inorganic coating compound, wherein the uniform constructional element with the frame structure has been achieved. According to the invention, an elastic sealing compound or a combination of the support mesh and the inorganic or mainly inorganic coating compound is arranged at least partly between the core layer and the upper surface layer of the element. Preferably, a sealing compound or a combination of the support mesh and the inorganic or mainly inorganic coating compound is arranged between the insulating core layer and the upper surface layer of the element so that they form a substantially uniform layer between the insulating core layer and the upper surface layer of the element. According to a preferred embodiment of the invention, an elastic sealing compound covers substantially all surfaces of the boards, i.e. also the joints between the boards comprise an elastic sealing compound. Thus, the durability of the element construction is further improved. Especially, by means of the elastic sealing compound or a combination of the support mesh and the inorganic or mainly inorganic coating compound, the effect of the shearing stress to the material of the insulating core layer can be eliminated. In some embodiments, the support mesh alone might be sufficient to provide required durability of the element. The element construction according to an embodiment of the invention is fully moisture resistant when the insulating core layer is made of foamed glass and covered with an elastic sealing compound.

An elastic sealing compound may be any suitable sealing component providing required elasticity properties. According to an embodiment of the invention, an elastic sealing compound may be latex, silicon or polyurethane based compound or mass. A suitable elastic sealing compound is selected on the basis of the desired properties of the element. One or more elastic sealing compounds may be used in the construction of the element. An elastic sealing compound may comprise adhesive, wherein an upper surface of the layer can also be attached by the elastic sealing compound to the insulating core layer. The inorganic or mainly inorganic coating compound used in the combination of the support mesh and the inorganic or mainly inorganic coating compound may be any suitable compound, which comprises a binder to be hardened during drying. A support mesh may also be any mesh suitable for the purpose, such as metal mesh, fibre glass-based mesh or any other inorganic fibre-based mesh, such as basalt mesh.

A frame structure of the element according to the invention comprises frame profiles, which form at least part of the outer edges of the element. In a preferred embodiment of the invention, the frame profiles form a framework of the element which circulates all outer edges of the insulating core layer. In some embodiments one or more outer edges of the element or a part of the outer edge(s), depending on the shape of the element, may be not covered with the frame profile wherein the insulating core layer is in visible on the outer edge(s) of the element. The frame profile is not essential, for example if the outer edge of the element is against the wall or the like in the application. The framework formed of the frame profiles functions as a load bearing structure of the element. A width of the frame profiles is typically same as a thickness of the element. According to an embodiment of the invention the frame profiles have been arranged between the upper and the lower surface layers on the outer edge of the element and they substantially cover the outer edges of the insulating core layer.

A frame structure of the element according to the invention further comprises elongated support profiles in the length and/or width direction of the element. Typically, the element comprises support profiles at least in a width direction or a length direction of the element. When the size of the element increases, the support profiles are typically arranged both in the width and the length direction of the element, wherein the frame structure comprises more supporting points. A distance between the support profiles may vary depending on the desired construction. The support profiles have typically been attached at their ends to the frame profiles, i.e. the support profiles are substantially perpendicular with respect to the frame profiles. The elongated support profiles of the frame structure are at least partly inside the insulating core layer in the final element construction. In an embodiment according to the invention, the elongated support profiles have been arranged inside the insulating core layer so that the insulating material of the core layer covers the elongated support profiles, wherein the elongated support profiles have been preferably arranged in the middle of the core layer.

A height of the elongated support profiles may vary depending on the element construction. According to an embodiment of the invention, a height of the elongated support profiles is substantially same as a thickness of the insulating core layer. According to another embodiment of the invention, a height of the elongated support profiles of the frame structure is smaller than a thickness of the insulating core layer. A height direction of the profile refers to a direction between the upper and the lower surface layers of the element, i.e. a thickness of the insulating core layer. In an embodiment of the invention, a height of the support profiles is at least about ⅓ of the thickness of the insulating core layer in order that the insulating core layer can be bound to the element construction. By this way a desired stiffness of the construction is also achieved, and a mass of the element will not increase too heavy.

In an embodiment of the invention, the frame structure, i.e. both the frame profiles and the elongated support profiles, is made of stainless steel, such as AiSi 304 or AiSi 316, or aluminium or galvanized steel, but the material of the frame structure can also be any other suitable material which provides desired properties for the final element construction and is suitable for this use. For example, the frame structure may be made of corrosion resistance composite materials. Especially, the material of the frame structure is selected on the basis of the bending strength requirements. A shape and a dimensioning of the elongated support profiles may vary depending on e.g. the size of the element and the application of the element. A wall thickness of the elongated support profile is typically about 0.5-5 mm.

The prefabricated construction element of the invention is a so-called sandwich-plate element, wherein at least an upper surface layer is arranged on the insulating core layer. In an embodiment of the invention, the element comprises an upper surface layer and a lower surface layer, which are arranged on the surfaces of the insulating core layer. The surface layers may be constructed on different materials depending on the application of the element and with selectable surface patterns. According to an embodiment of the invention an upper surface layer of the element may comprise a glass fibre layer. In an embodiment of the invention, an upper surface layer of the element may comprise tiles or the like, or it may be formed of e.g. sheet metal, sheet steel, reinforced plastic or the like. When the element is a floor element, the upper surface layer is the upper surface of the floor element.

In an embodiment of the invention the lower surface layer of the element may be formed of e.g. sheet metal, sheet steel, reinforced plastic or the like.

According to an embodiment of the invention, the element may further comprise required pipes, channels and cables, such as e.g. drainage pipes, air ducts and floor heating pipes or cables, as an integrated part of the element. Typically these pipes, channels or cables are an integrated part of the insulating core layer. Also, a different kind of housings can be arranged inside the element so that they are embedded into the insulating core layer.

According to an embodiment of the invention an element may further comprise adjustable levelling with adjustable feet arranged on the lower surface of the element. This enables easy levelling of the element in the desired position, especially when the element is used as a floor element.

The dimensioning of the element may vary depending on the requirements and application needs and there is no limit to the area of the element. According to an embodiment of the invention length and width of the element may be in the range of about 1000-30000 mm. The thickness of the element, i.e. a distance between the surface layers, or the thickness of the insulating core layer is typically about 30-300 mm.

The element construction of the invention provides a lightweight element, which means that the weight of the element is typically in the range of about 15-50 kg/m$^2$.

Most of the materials used in the elements according to the invention are recyclable after renovation. For example, the foamed glass used as an insulation material is fully recyclable.

DESCRIPTION OF THE DRAWINGS

The invention will be described in more detail with reference to appended FIG. 1, which shows a structure of the framed element according to an embodiment of the invention.

DETAILED DESCRIPTION OF THE INVENTION

FIG. 1 illustrates structural elements of a framed element 10 according to an embodiment of the invention. The framed element 10 comprises at least an insulating core layer 1, an upper surface layer 2 arranged on the insulating core layer and a frame structure 3. The insulating core layer 1 of the element 10 showed in FIG. 1 is made of a plurality of the insulating material boards 1*a*, 1*b*. The boards may be foamed glass boards or manufactured from a combination of lightweight aggregates and fire-retardant resin. The boards are arranged into the frame structure of the element for forming an integrated insulation layer. The frame structure 3 illustrated in FIG. 1 comprises the frame profiles 3*a* which have been arranged to form the outer edges of the element and the elongated support profiles 3*b* in the length and width direction of the element. The elongated support profiles 3*b* have been attached at their ends to the frame profiles 3*a*. In the final element construction, the elongated support profiles 3*b* are at least partly inside the core layer 1, i.e, between the insulating core material boards. The boards 1*a*, 1*b* and the upper surface layer 2 of the element have been attached to the frame structure 3 by an elastic sealing compound 1*c* or a combination of the support mesh and the inorganic or mainly inorganic coating compound. The elastic sealing compound 1*c* or a combination of the support mesh and the inorganic or mainly inorganic coating compound is arranged at least partly uniformly between the core layer 1 and the upper surface layer 2 of the element, and also the joints between the boards forming the insulating core layer may comprise an elastic sealing compound 1*c*.

The element showed in FIG. 1 does not comprise a lower surface layer, but it may comprise if needed.

The invention claimed is:

1. A framed and a fireproof construction element, comprising:

an insulating core layer made of a foamed glass or a combination of lightweight aggregates and a fire-retardant resin, an upper surface layer arranged on the insulating core layer, a frame structure forming a load-bearing structure of the element and comprising frame profiles which have been arranged to form at least a part of outer edges of the element and elongated support profiles in a length and/or in a width direction of the element, and which elongated support profiles, have been arranged at least partly inside the core layer, and an elastic sealing compound or a combination of a support mesh and an inorganic or mainly inorganic coating compound applied on the surface of the insulating core layer, wherein the elastic sealing compound forms substantially a uniform layer between the insulating core layer and the upper surface layer of the element, and wherein the element is a floor, a wall or a roof element.

2. The element according to claim 1, wherein the combination of the lightweight aggregates and the fire-retardant resin comprising:

the lightweight aggregates selected from the group comprising expanded clay aggregates, aggregates made of concrete, mortar, plaster, vermiculite or perlite and any combination of them, and a fire-resistant resin or a glue is used as the fire-retardant resin.

3. The element according to claim 1, wherein the insulating core layer comprises one or more boards made of foamed glass or a combination of the lightweight aggregates and the fire-retardant resin.

4. The element according to claim 3, wherein the elastic sealing compound has been arranged between the boards.

5. The element according to claim 1, wherein the insulating core layer made of the combination of the lightweight aggregates and the fire-retardant resin is poured directly into the frame structure.

6. The element according to claim 1, wherein the elongated support profiles have been arranged inside the insulating core layer.

7. The element according to claim 1, wherein a height of the elongated support profiles of the frame structure is substantially same as a thickness of the insulating core layer.

8. The element according to claim 1, wherein a height of the elongated support profiles is at least about ⅓ of a thickness of the insulating core layer.

9. The element according to claim 1, wherein the frame structure is made of stainless steel, aluminium or galvanized steel.

10. The element according to claim 1, wherein the element is a floor element in a wet unit module.

* * * * *